US011840088B2

(12) United States Patent
Arafuka

(10) Patent No.: US 11,840,088 B2
(45) Date of Patent: Dec. 12, 2023

(54) WIPING UNIT AND LIQUID EJECTING APPARATUS

(71) Applicant: SEIKO EPSON CORPORATION, Tokyo (JP)

(72) Inventor: Kazushi Arafuka, Matsumoto (JP)

( * ) Notice: Subject to any disclaimer, the term of this patent is extended or adjusted under 35 U.S.C. 154(b) by 7 days.

(21) Appl. No.: 17/808,387

(22) Filed: Jun. 23, 2022

(65) Prior Publication Data

US 2022/0410573 A1 Dec. 29, 2022

(30) Foreign Application Priority Data

Jun. 25, 2021 (JP) ..... 2021-105464

(51) Int. Cl.
*B41J 2/165* (2006.01)

(52) U.S. Cl.
CPC ..... *B41J 2/16535* (2013.01); *B41J 2/16517* (2013.01); *B41J 2/16526* (2013.01); *B41J 2002/1655* (2013.01)

(58) Field of Classification Search
CPC ..... B41J 2/16535; B41J 2/16517; B41J 2/16526; B41J 2002/1655
See application file for complete search history.

(56) References Cited

U.S. PATENT DOCUMENTS 7,811,015 B2 * 10/2010 Yanagi ..... B41J 13/0045 400/582
8,403,455 B2 * 3/2013 Hayashi ..... B41J 2/16526 347/31
2013/0120495 A1 5/2013 Nakamura et al.

FOREIGN PATENT DOCUMENTS

JP 2013103378 A 5/2013
JP 2019043031 A 3/2019
JP 2019104132 A 6/2019

* cited by examiner

*Primary Examiner* — Geoffrey S Mruk
(74) *Attorney, Agent, or Firm* — CHIP LAW GROUP

(57) ABSTRACT

A wiping unit includes a wiping member with a long shape configured to wipe a liquid ejecting head configured to discharge liquid, a first roller around which to wind the wiping member, a second roller configured to wind up the wiping member fed out from the first roller, a driving force transmission mechanism configured to transmit a driving force of a driving source to the second roller, a conveyance roller configured to make contact with the wiping member and rotate along with a movement of the wiping member, a first detection unit configured to detect a rotation amount of the first roller, and a second detection unit configured to detect a rotation amount of the conveyance roller.

8 Claims, 4 Drawing Sheets

WIPING UNIT AND LIQUID EJECTING APPARATUS

The present application is based on, and claims priority from JP Application Serial Number 2021-105464, filed Jun. 25, 2021, the disclosure of which is hereby incorporated by reference herein in its entirety.

BACKGROUND

1. Technical Field

The present disclosure relates to a wiping unit and a liquid ejecting apparatus including the wiping unit.

2. Related Art

For example, as disclosed in JP-A-2019-104132, a wiping unit that wipes a liquid ejecting head by using a wiping member is known. The wiping unit winds up a wiping member fed out from a feeding roller, which is an example of a first roller, around a winding roller, which is an example of a second roller, through a conveyance roller. The wiping unit includes an encoder that detects the feeding amount of the wiping member on the basis of the rotation amount of the conveyance roller.

The feeding amount of the wiping member that is fed during one rotation of the conveyance roller changes depending on the thickness of the wiping member, the tension exerted on the wiping member, slippage between the wiping member and the conveyance roller and the like. As such, the feeding amount of the wiping member calculated from the rotation amount of the conveyance roller may deviate from the actual feeding amount in some situation. For example, if the remaining amount of the wiping member is calculated by accumulating the calculated feeding amount, the deviation from the actual feeding amount may also be accumulated, and consequently the calculated remaining amount and the actual remaining amount may deviate from each other.

SUMMARY

A wiping unit for solving the above-mentioned problems includes a wiping member with a long shape configured to wipe a liquid ejecting head configured to discharge liquid, a first roller around which to wind the wiping member, a second roller configured to wind up the wiping member fed out from the first roller, a driving force transmission mechanism configured to transmit a driving force of a driving source to the second roller, a conveyance roller configured to make contact with the wiping member and rotate along with a movement of the wiping member, a first detection unit configured to detect a rotation amount of the first roller, and a second detection unit configured to detect a rotation amount of the conveyance roller.

A liquid ejecting apparatus for solving the above-mentioned problems includes the liquid ejecting head configured to discharge the liquid, the wiping unit with the above-described configuration, the driving source, and a control unit. The control unit calculates a diameter of the wiping member wound around the first roller, based on a detection result of the first detection unit and a detection result of the second detection unit.

DESCRIPTION OF EXEMPLARY EMBODIMENTS

First Embodiment

Figure 1:
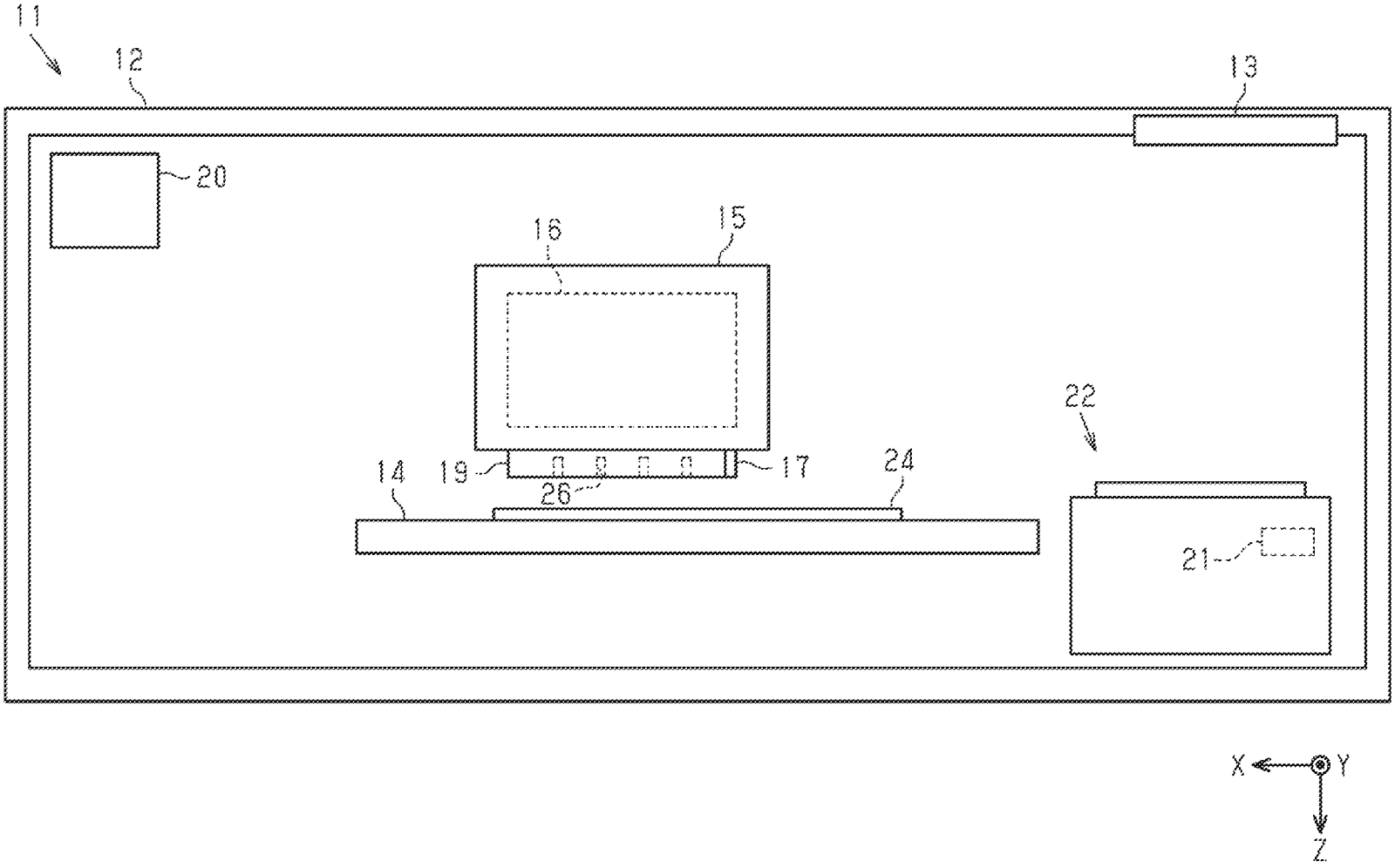
FIG. 1 is a schematic view of a liquid ejecting apparatus of a first embodiment.

A wiping unit and a liquid ejecting apparatus according to a first embodiment are described below with reference to the drawings. The liquid ejecting apparatus is, for example, an ink-jet printer that performs recording of images such as letters and photographs by discharging ink as an example of liquid onto a medium such as sheets, fabric, vinyl, plastic components and metal components.

In the drawings, it is assumed that a liquid ejecting apparatus 11 is placed on a horizontal plane, the gravity direction is indicated as the Z axis, and the directions along the horizontal plane are indicated as the X axis and the Y axis. The X axis, Y axis, and Z axis are orthogonal to each other.

As illustrated in FIG. 1, the liquid ejecting apparatus 11 includes a housing 12, a notification unit 13, a supporting unit 14, a carriage 15, a liquid housing part 16, and a curing unit 17. The liquid ejecting apparatus 11 includes a liquid ejecting head 19, a control unit 20, a driving source 21, and a wiping unit 22.

The housing 12 houses various components provided in the liquid ejecting apparatus 11.

The notification unit 13 may be a display unit, such as a liquid crystal panel, that can display information, for example. The notification unit 13 may be a touch panel at which information can be displayed and input. The notification unit 13 may provide a notification of information by displaying letters and images.

The supporting unit 14 is configured to support a medium 24. The supporting unit 14 supports the medium 24 that is conveyed along the Y axis, for example.

The liquid housing part 16 and the liquid ejecting head 19 may be mounted in the carriage 15. Through scanning with respect to the medium 24, the carriage 15 moves the liquid housing part 16 and the liquid ejecting head 19. The carriage 15 of the embodiment moves back and forth along the X axis and the Y axis. That is, the liquid ejecting apparatus 11 of the embodiment is a so-called lateral printer. The liquid ejecting apparatus 11 may be a serial printer that performs scanning with respect to the medium 24, or a line printer that can discharge liquid at the same time across the width of the medium 24.

The liquid housing part 16 is configured to house liquid. The liquid housing part 16 houses liquid to be supplied to the liquid ejecting head 19. The liquid housing part 16 is connected to the liquid ejecting head 19 through a channel, which is not illustrated in the drawing. The liquid housing part 16 of the embodiment houses UV ink.

The curing unit 17 is mounted in the carriage 15, for example. The curing unit 17 may include a light-emitting element that emits an ultraviolet ray. The curing unit 17 cures the liquid discharged to the medium 24 by irradiating the medium 24 with an ultraviolet ray. When cured, the liquid is fixed to the medium 24.

The liquid ejecting head 19 is configured to discharge liquid. The liquid ejecting head 19 includes one or more nozzles 26 that discharge liquid. The liquid ejecting head 19 records images on the medium 24 by discharging liquid from the nozzle 26 to the medium 24 supported by the supporting unit 14.

At the liquid ejecting head 19, maintenance is performed for the purpose of appropriately discharging liquid from the nozzle 26. Examples of the maintenance of the liquid ejecting head 19 include flushing, cleaning, and wiping.

The flushing is an operation of appropriately discharging liquid from the nozzle 26 to reduce the clogging of the nozzle 26. The flushing is performed before the recording, during the recording, or after the recording, for example. Upon execution of the flushing, the liquid ejecting head 19 may discharge liquid toward the wiping unit 22.

The cleaning is an operation of forcibly ejecting liquid from the nozzle 26 for the purpose of ejecting the foreign matters, bubbles and the like existing in the liquid ejecting head 19. The cleaning of the embodiment is press-cleaning of forcibly ejecting the liquid from the nozzle 26 by applying a pressure to the interior of the liquid ejecting head 19. The cleaning is performed before the recording or after the recording, for example. Upon execution of the cleaning, the liquid ejecting head 19 may eject liquid toward the wiping unit 22.

The wiping is an operation of wiping the liquid ejecting head 19 to remove the liquid adhered on the liquid ejecting head 19. The wiping is performed after the cleaning, for example. Upon execution of the wiping, the liquid ejecting head 19 is wiped by the wiping unit 22.

The control unit 20 generally controls the liquid ejecting apparatus 11, for example. The control unit 20 controls the carriage 15, the liquid ejecting head 19, and the wiping unit 22, for example. The control unit 20 may be configured as a circuit including α: one or more processors that execute various processes in accordance with a computer program, one or more dedicated hardware circuits that execute at least β: some of various processes, or γ: a combination of them. The hardware circuit is an application-specific integrated circuit, for example. The processor includes a CPU and a memory such as RAM and ROM, and the memory stores program codes or instructions configured to cause the CPU to perform processing. The memory, i.e., a computer readable medium, includes any readable medium that can be accessed by a general-purpose or dedicated computer.

The driving source 21 is configured to drive the wiping unit 22. The driving source 21 may be provided in the wiping unit 22, or may be attached to the wiping unit 22, or, may be provided separately from the wiping unit 22. The driving source 21 is an electric motor such as a DC motor, an AC motor and a stepping motor, for example.

Wiping Unit

The wiping unit 22 collects the liquid waste generated by the maintenance of the liquid ejecting head 19. The liquid waste is liquid supplied from the liquid housing part 16 to the liquid ejecting head 19 that does not contribute to the image recorded on the medium 24. The wiping unit 22 is located at a position adjacent to the supporting unit 14, for example. The wiping unit 22 collects the liquid waste from the liquid ejecting head 19 located immediately above it, for example.

Figure 2:
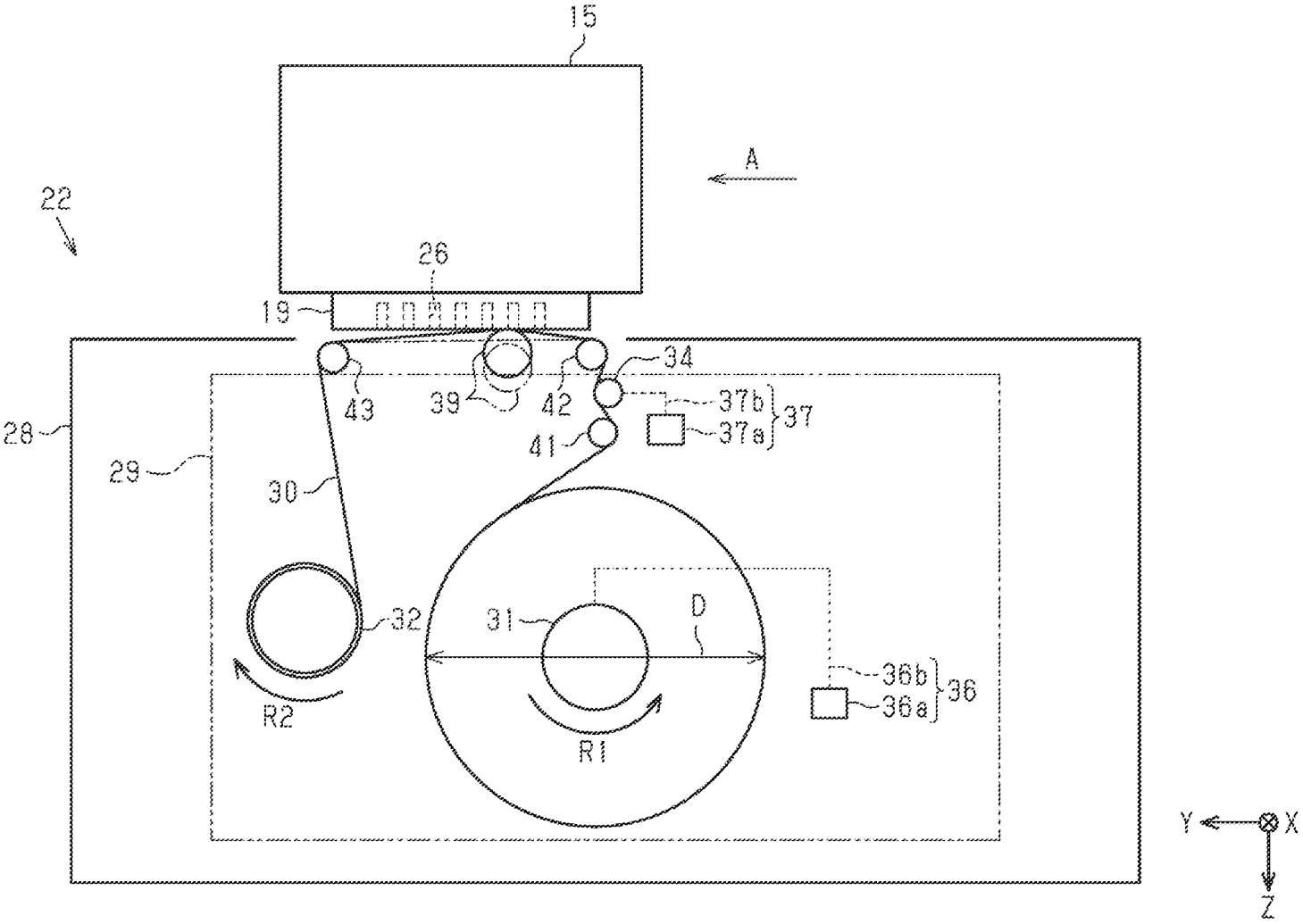
FIG. 2 is a schematic view of a wiping unit.

As illustrated in FIG. 2, the wiping unit 22 may include a case 28. The wiping unit 22 may include a driving force transmission mechanism 29, a wiping member 30, a first roller 31, a second roller 32, a conveyance roller 34, a first detection unit 36, and a second detection unit 37. The wiping unit 22 may include a pressing portion 39, and a first guide roller 41 to a third guide roller 43. The first roller 31, the second roller 32, the conveyance roller 34, the pressing portion 39, and the first guide roller 41 to the third guide roller 43 may be parallel to each other along the X axis, for example.

The conveyance roller 34, the pressing portion 39, and the first guide roller 41 to the third guide roller 43 are rotatably held by the case 28, for example. The conveyance roller 34, the pressing portion 39, and the first guide roller 41 to the third guide roller 43 rotate to follow the conveyance of the wiping member 30.

The case 28 houses various components provided in the wiping unit 22. The case 28 is configured to be detachable from the housing 12, for example. Therefore, the wiping unit 22 is replaceable in the liquid ejecting apparatus 11.

Figure 3:
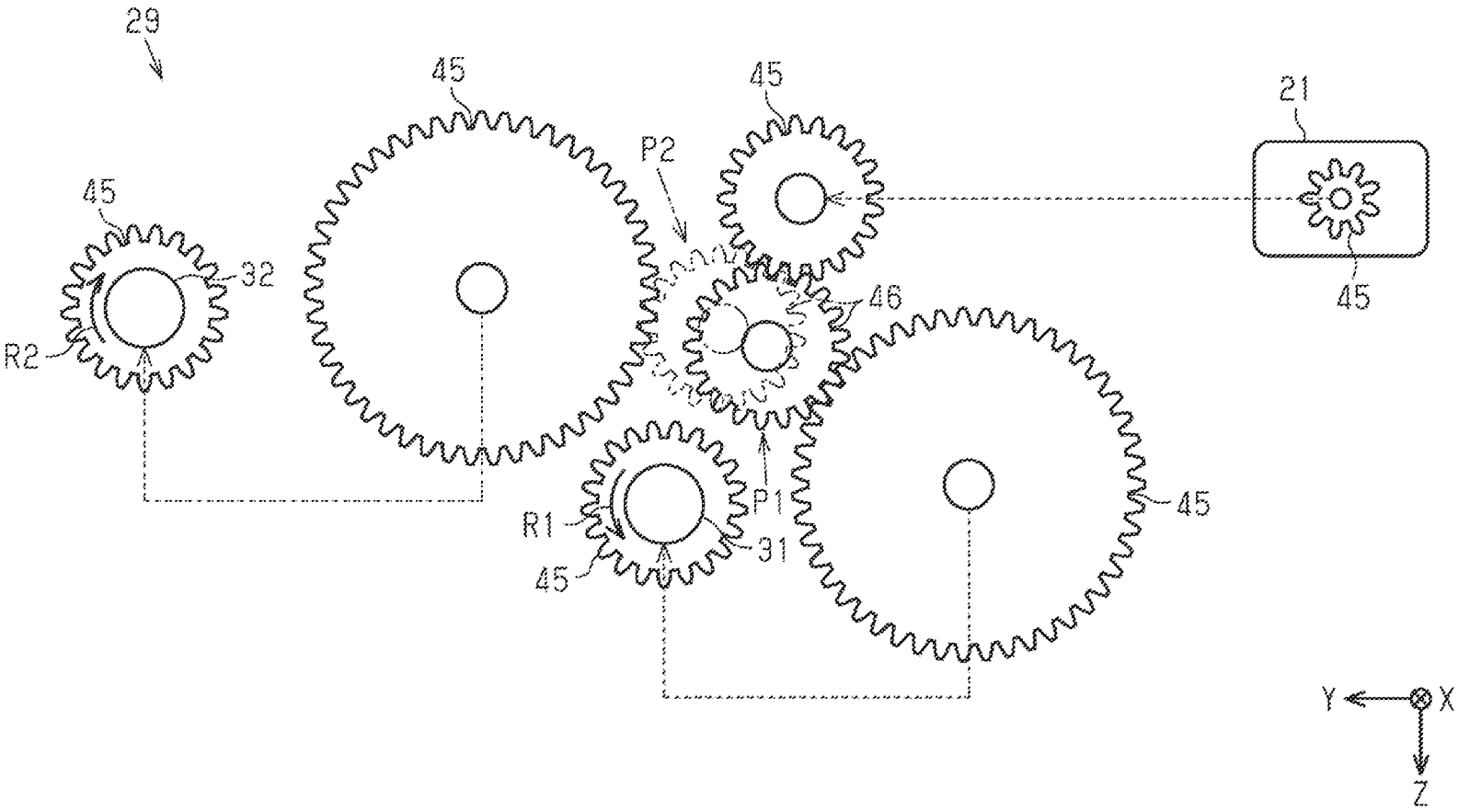
FIG. 3 is a schematic view of a driving force transmission mechanism.

As illustrated in FIG. 3, the driving force transmission mechanism 29 includes a plurality of fixed gears 45 and a movable gear 46. The fixed gear 45 is a gear whose axis position does not change with respect to the case 28. The movable gear 46 is a gear whose axis is movable with respect to the case 28. In FIG. 3, the illustration of some fixed gears 45 is omitted, and the direction of the driving force transmitted by the omitted fixed gear 45 is illustrated with the broken arrow.

The driving force transmission mechanism 29 transmits the driving force of the driving source 21 to the second roller 32. The driving force transmission mechanism 29 can transmit the driving force of the driving source 21 also to the first roller 31. The driving force transmission mechanism 29 of the embodiment switches the transmission destination of the power in accordance with the driving direction of the driving source 21. More specifically, in the driving force transmission mechanism 29, the movable gear 46 moves in accordance with the driving direction of the driving source 21 and the fixed gear 45 that engages with the movable gear 46 is switched.

When the driving source 21 is driven in reverse, the movable gear 46 moves to a first position P1 indicated with the solid line in FIG. 3. The movable gear 46 located at the first position P1 transmits the driving force to the first roller 31. Specifically, the driving force transmission mechanism 29 forms a transmission path of the power connecting the driving source 21 and the first roller 31, and separates the second roller 32 from the transmission path of the power. In this manner, the first roller 31 rotates in an unwinding direction R1. The unwinding direction R1 is a direction in which the first roller 31 winds up the wiping member 30. At this time, the second roller 32 becomes rotatable.

When the driving source 21 is driven in forward rotation, the movable gear 46 moves to a second position P2 indicated with the chain double-dashed line in FIG. 3. The movable gear 46 located at the second position P2 transmits the driving force to the second roller 32. Specifically, the driving force transmission mechanism 29 forms a transmission path of the power connecting the driving source 21 and the second roller 32, and separates the first roller 31 from the transmission path of the power. In this manner, the second roller 32 rotates in a winding direction R2. The winding direction R2 is a direction in which the second roller 32 winds up the wiping member 30. At this time, the first roller 31 becomes rotatable.

As illustrated in FIG. 2, when the first roller 31 rotates in the unwinding direction R1, the first roller 31 winds up the wiping member 30. The first roller 31 pulls the wiping member 30. Thus, the wiping member 30 is fed from the second roller 32 to the first roller 31, and the wiping member 30 is pulled out from the second roller 32. The second roller 32, the conveyance roller 34, the pressing portion 39, and the first guide roller 41 to the third guide roller 43 rotate to follow the rotation of the first roller 31.

When the second roller 32 rotates in the winding direction R2, the second roller 32 winds up the wiping member 30. The second roller 32 pulls the wiping member 30. Thus, the wiping member 30 is fed from the first roller 31 to the second roller 32, and the wiping member 30 is pulled out from the first roller 31. The first roller 31, the conveyance roller 34, the pressing portion 39, and the first guide roller 41 to the third guide roller 43 rotate to follow the rotation of the second roller 32.

The wiping member 30 is for wiping the liquid ejecting head 19. The wiping member 30 is configured in a long shape. The wiping member 30 is capable of absorbing liquid waste. The wiping member 30 is a cloth or a sponge, for example.

The wiping member 30 is held by the first roller 31 and the second roller 32. The wiping member 30 is wound around the first guide roller 41, the conveyance roller 34, second guide roller 42, the pressing portion 39, and the third guide roller 43 in this order along the conveyance path from the first roller 31, and is wound around the second roller 32.

The first roller 31 and the second roller 32 rotate to unwind and wind up the wiping member 30. The first roller 31 is configured to wind the wiping member 30 around it. The first roller 31 of the embodiment holds the unused wiping member 30 rolled and stacked in a roll form. The first roller 31 rotates integrally with the wiping member 30 in the roll form.

The second roller 32 winds up the wiping member 30 fed out from the first roller 31. The second roller 32 of the embodiment winds up the used wiping member 30. The second roller 32 rotates integrally with the wound wiping member 30 in the roll form.

The conveyance roller 34 is configured to make contact with the wiping member 30 and to be rotatable along with the movement of the wiping member 30. The conveyance roller 34 may make contact with the wiping member 30 between the pressing portion 39 and the first roller 31. The conveyance roller 34 of the embodiment makes contact with the wiping member 30 between the first guide roller 41 and second guide roller 42.

The first detection unit 36 is configured to be able to detect the rotation amount of the first roller 31. The first detection unit 36 may include a first encoder 36*a* configured to detect rotation, and a first transmission unit 36*b* configured to transmit the rotation of the first roller 31 to the first encoder 36*a*. The first transmission unit 36*b* may be composed of a plurality of gears.

The second detection unit 37 is configured to be able to detect the rotation amount of the conveyance roller 34. The second detection unit 37 may include a second encoder 37*a* configured to detect rotation, and a second transmission unit 37*b* configured to transmit the rotation of the conveyance roller 34 to the second encoder 37*a*. The second transmission unit 37*b* may be composed of a plurality of gears.

The pressing portion 39 may be configured to move to a wiping position indicated with the solid line in FIG. 2 and a retreat position indicated with the two-dotted line in FIG. 2. When the pressing portion 39 is located at the retreat position, the wiping member 30 does not make contact with the liquid ejecting head 19. By moving to the wiping position, the pressing portion 39 pushes the wiping member 30 toward the liquid ejecting head 19. When the pressing portion 39 is located at the wiping position, the wiping member 30 can make contact with the liquid ejecting head 19. The pressing portion 39 may move in accordance with the maintenance of the liquid ejecting head 19 to be performed.

When the wiping is performed, the pressing portion 39 is located at the wiping position. The liquid ejecting apparatus 11 performs the wiping by relatively moving the liquid ejecting head 19 and the wiping unit 22, with the pressing portion 39 located at the wiping position. One or both of the wiping unit 22 and the liquid ejecting head 19 may move. In the embodiment, the wiping is performed with the liquid ejecting head 19 moving in a movement direction A. The movement direction A is a direction parallel to the Y axis, for example. The wiping member 30 collects the liquid adhered to the liquid ejecting head 19 by wiping the liquid ejecting head 19.

When the cleaning or flushing is performed, the pressing portion 39 is located at the retreat position. The liquid ejecting apparatus 11 performs the cleaning or flushing, with the liquid ejecting head 19 located at a position where the nozzle 26 faces the wiping member 30. The wiping member 30 collects the liquid dropped from the liquid ejecting head 19 or the liquid discharged from the nozzle 26.

The wiping unit 22 may collect the liquid waste in the state where the wiping member 30 is stopped, or may collect the liquid waste while feeding the wiping member 30. The wiping unit 22 may collect the liquid waste while feeding the wiping member 30 when the amount of the liquid waste is large, such as in the cleaning, for example. More specifically, the wiping unit 22 may collect the liquid waste while causing the second roller 32 to wind up the wiping member 30.

The wiping unit 22 feeds the wiping member 30 from the first roller 31 to the second roller 32 each time when the maintenance of the liquid ejecting head 19 is performed, for example. The wiping unit 22 may collect the liquid waste using the unused wiping member 30 each time when the maintenance of the liquid ejecting head 19 is performed.

The curing unit 17 may cure the liquid waste by irradiating the wiping member 30 that has collected the liquid waste, with an ultraviolet ray. The curing unit 17 may cure the liquid waste after the maintenance of the liquid ejecting head 19 has been completed, or may cure the liquid waste in parallel with the maintenance of the liquid ejecting head 19. The curing unit 17 may cure the liquid waste collected by the wiping member 30 after the maintenance of the liquid ejecting head 19 has been performed multiple times.

The liquid ejecting apparatus 11 may cure the liquid waste collected by the wiping member 30 while feeding the wiping member 30 back to the first roller 31. Thereafter, the liquid ejecting apparatus 11 may feed the wiping member 30 to the second roller 32 until the portion where the liquid waste has been cured passes through the pressing portion 39 or the third guide roller 43.

Figure 4:
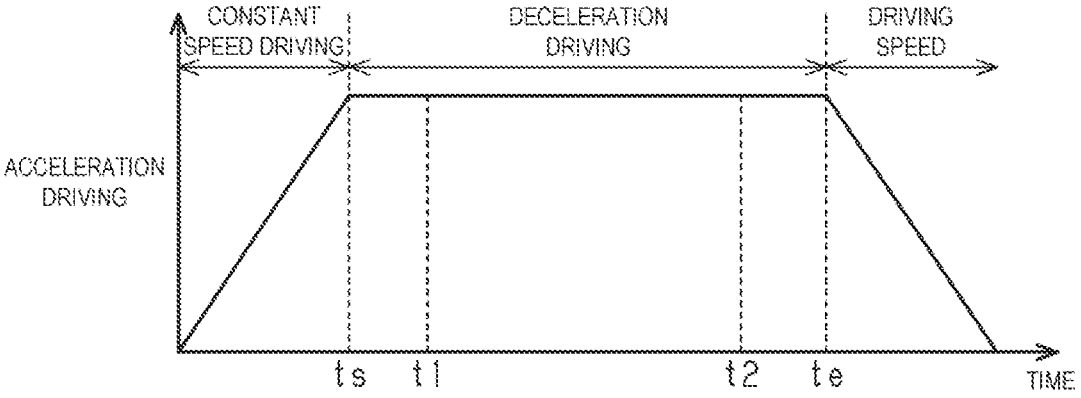
FIG. 4 is a graph illustrating a driving speed of a driving source.

As illustrated in FIG. 4, the driving source 21 may be configured to perform acceleration driving for acceleration at the start of driving, constant speed driving for driving at a constant speed, and deceleration driving for deceleration at the stop of the driving. The control unit 20 may control the driving of the driving source 21 on the basis of the detection result of the second detection unit 37. Specifically, the control unit 20 may control the driving source 21 so as to drive and accelerate the driving source 21 until the conveyance roller 34 is set to a predetermined rotational speed and to drive it at a constant speed while maintaining the predetermined rotational speed.

During the constant speed driving, slippage between the wiping member 30 and the conveyance roller 34 less occurs than during the acceleration driving and the deceleration driving. The control unit 20 of the embodiment calculates a diameter D illustrated in FIG. 2 on the basis of the rotation amount of each of the first roller 31 and the conveyance roller 34 during the constant speed driving. The diameter D is the diameter of the wiping member 30 wound around the first roller 31 in a roll form.

More specifically, the control unit 20 acquires the rotation amount of the first roller 31 and the conveyance roller 34 that have rotated from a first time point t1 to a second time point t2. The first time point t1 is a time point after a point is at which the constant speed driving is started. The second time point t2 is a time point after the first time point t1 and before a time point to at which the constant speed driving is completed. The first time point t1 and the second time point t2 may be set in advance, or may be set by the control unit 20 on the basis of the detection result of at least one of the first detection unit 36 and the second detection unit 37.

The control unit 20 acquires a first pulse count output by the first detection unit 36 from the first time point t1 to the second time point t2. The control unit 20 acquires a second pulse count output by the second detection unit 37 from the first time point t1 to the second time point t2. Specifically, the first pulse count and the second pulse count are the number of pulses output by the first detection unit 36 and the second detection unit 37 in the same period.

The control unit 20 calculates a feeding amount a of the wiping member 30, from the second pulse count. The control unit 20 calculates the diameter D of the wiping member 30 on the basis of the calculated feeding amount a and the first pulse count output by the first detection unit 36.

The feeding amount a of the wiping member 30 that has been fed in the period from the first time point t1 to the second time point t2 can be expressed by the following Expression (1).

[Math 1]

$$a = \frac{c}{d} \cdot (e + f) \cdot \pi \tag{1}$$

c is the second pulse count output by the second detection unit 37 in the period from the first time point t1 to the second time point t2. d is the pulse count that is output by the second detection unit 37 during one rotation of the conveyance roller 34. Accordingly, c/d is the rotation amount of the conveyance roller 34. A pulse count d during one rotation of the conveyance roller 34 is set in advance based on the gear ratio of the gear provided in the second transmission unit 37*b*, experiment results and the like, and is stored in the control unit 20.

Figure 5:
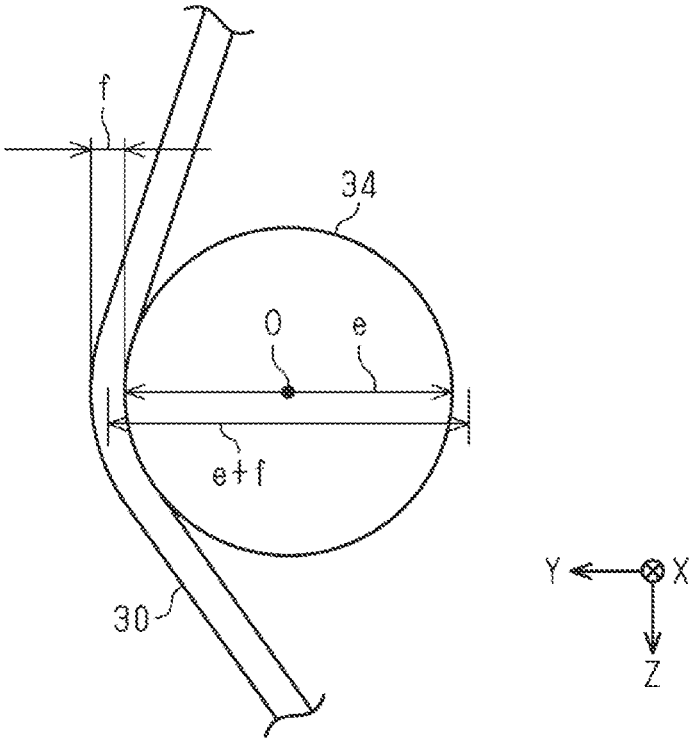
FIG. 5 is a schematic view of a conveyance roller and a wiping member.

As illustrated in FIG. 5, e is the diameter of the conveyance roller 34. f is the thickness of the wiping member 30. The control unit 20 may store the diameter e and the thickness f in advance. e+f is the diameter when a center O of the conveyance roller 34 to the center of the wiping member 30 is the radius.

The wiping member 30 is fed to the second roller 32 through the conveyance roller 34 by the amount fed out from the first roller 31. Therefore, the feeding amount a of the wiping member 30 is equal to the amount fed out from the first roller 31. As such, the feeding amount a can be expressed by the following Expression (2).

[Math 2]

$$a = \frac{g}{h} \cdot D \cdot \pi \tag{2}$$

g is the first pulse count output by the first detection unit 36 in the period from the first time point t1 to the second time point t2. h is the pulse count output by the first detection unit 36 during one rotation of the first roller 31. That is, g/h is the rotation amount of the first roller 31. A pulse count h during one rotation of the first roller 31 may be set in advance based on the gear ratio of the gear provided in the first detection unit 36, experiment results and the like, and may be stored by the control unit 20.

As illustrated in FIG. 2, D is the diameter of the wiping member 30 held by the first roller 31. Therefore, D-n is the amount of the wiping member 30 fed out during one rotation of the first roller 31.

As expressed in the following Expression (3), when the number of rotations of the first roller 31 is b, the diameter D of the wiping member 30 held by the first roller 31 is expressed by the following Expression (4) from Expressions (1) to (3).

[Math 3]

$$b = \frac{g}{h} \tag{3}$$

[Math 4]

$$D = \frac{a}{b\pi} \tag{4}$$

Operations

The control unit 20 calculates the diameter D of the wiping member 30 wound around the first roller 31 on the basis of the detection result of the first detection unit 36 and the detection result of the second detection unit 37. The control unit 20 may calculate the diameter D of the wiping member 30 at any timing. When feeding the wiping member 30 to the second roller 32, the control unit 20 may calculate the diameter D of the wiping member 30 on the basis of the rotation amount of the first roller 31 detected by the first detection unit 36 and the rotation amount of the second roller 32 detected by the second detection unit 37. When feeding the wiping member 30 back to the first roller 31, the control unit 20 may calculate the diameter D of the wiping member 30 on the basis of the rotation amount of the first roller 31 detected by the first detection unit 36 and the rotation amount of the second roller 32 detected by the second detection unit 37.

The control unit 20 may store a table representing the relationship between the diameter D of the wiping member 30 and the remaining amount. The control unit 20 may acquire the remaining amount on the basis of the calculated diameter D. The control unit 20 may calculate the remaining amount on the basis of the calculated diameter D. The remaining amount of the wiping member 30 is the length of the wiping member 30 wound around the first roller 31. In other words, the remaining amount of the wiping member 30 is the length of the wiping member 30 that can be fed out from the first roller 31.

The control unit 20 may provide a notification when the calculated diameter D of the wiping member 30 falls below a predetermined value. For example, the control unit 20 may provide a notification when the remaining amount determined based on the diameter D falls below the amount required for the maintenance. Specifically, the control unit 20 may control the notification unit 13 to cause it to provide a notification to replace the wiping member 30 or the wiping unit 22. The control unit 20 may provide a notification that the replacement timing of the wiping member 30 or the wiping unit 22 is near when the value falls below a threshold value set in advance.

Effects of the embodiment are described below.

(1) The relationship between the feeding amount of the wiping member 30 fed out by the rotation of the first roller 31 and the rotation amount of the first roller 31 changes depending on the diameter D of the wiping member 30 wound around the first roller 31. Since the wiping member 30 has a long shape, the wiping member 30 is fed out from the first roller 31 by the amount wound around the second roller 32, and is moved by the amount to rotate the conveyance roller 34. The first detection unit 36 detects the rotation amount of the first roller 31, and the second detection unit 37 detects the rotation amount of the conveyance roller 34. Thus, the remaining amount of the wiping member 30 wound around the first roller 31 can be accurately detected.

(2) The rotation amount of the conveyance roller 34 with respect to the feeding amount a of the wiping member 30 may change depending on the amount of the liquid adhered on the wiping member 30 and the like. In view of this, the conveyance roller 34 makes contact with the wiping member 30 between the pressing portion 39 and the first roller 31. That is, the conveyance roller 34 makes contact with the wiping member 30 before the wiping of the liquid ejecting head 19, and thus the detection accuracy of the remaining amount of the wiping member 30 can be improved.

(3) The driving force transmission mechanism 29 can transmit the driving force of the driving source 21 to the first roller 31. That is, the driving source 21 can rotate the first roller 31 and the second roller 32. When the first roller 31 rotates, the wiping member 30 is fed out from the second roller 32 and fed to the first roller 31, and, wound around the first roller 31. When the second roller 32 rotates, the wiping member 30 is fed out from the first roller 31 and fed to the second roller 32, and, wound around the second roller 32. Thus, the first roller 31 fed out from the wiping member 30 can be rewound around the first roller 31.

(4) The control unit 20 calculates the diameter D of the wiping member 30 wound around the first roller 31 on the basis of the rotation amount of each of the first roller 31 and the conveyance roller 34 during the constant speed driving. During the constant speed driving, the slippage between the wiping member 30 and the conveyance roller 34 less occurs than during the acceleration driving and the deceleration driving. Thus, the diameter D of the wiping member 30 can be more accurately calculated.

(5) When the diameter D of the wiping member 30 wound around the first roller 31 falls below a predetermined value, the control unit 20 provides a notification. Thus, a notification that the remaining amount of the wiping member 30 is small can be provided to the user.

Second Embodiment

Next, a wiping unit and a liquid ejecting apparatus according to a second embodiment is described. Note that the second embodiment is different from the first embodiment in the configurations of the driving source and the first detection unit. Since the other points are substantially the same as the first embodiment, the same configurations are denoted by the same reference numerals and overlapping description will be omitted.

The driving source 21 of the embodiment may be a servomotor. The servomotor includes an encoder, and can output its the number of rotations. Specifically, the servomotor also functions as the first detection unit 36. In other words, the driving source 21 and the first detection unit 36 may be composed of a servomotor.

As in the first embodiment, the control unit 20 calculates the diameter D of the wiping member 30 on the basis of Expressions (1) to (4). g of the embodiment is the number of rotations made by the driving source 21 in the period from the first time point t1 to the second time point t2. h of the embodiment is the number of rotations of the driving source 21 required to make one rotation of the first roller 31. That is, g/h is the rotation amount of the first roller 31 in the period from the first time point t1 to the second time point t2. A number of rotations h of the driving source 21 required to make one rotation of the first roller 31 is set in advance on the basis of the gear ratio of the gear connecting the first roller 31 and the driving source 21, experiment results and the like, and is stored in the control unit 20.

Operations

The control unit 20 calculates the diameter D of the wiping member 30 on the basis of the rotation amount of the first roller 31 when the driving source 21 rotates the first roller 31, and the rotation amount of the conveyance roller 34 detected by the second detection unit 37. Specifically, the control unit 20 calculates the diameter D of the wiping member 30 on the basis of the rotation amount of the first roller 31 and the conveyance roller 34 when the wiping member 30 is fed back to the first roller 31. The control unit 20 may provide a notification when the calculated diameter D of the wiping member 30 falls below a predetermined value.

Effects of the embodiment are described below.

(6) The driving force transmission mechanism 29 rotates the first roller 31 by transmitting the driving force of the servomotor to the first roller 31. Therefore, the rotation amount of the first roller 31 is proportional to the number of rotations of the servomotor. That is, the servomotor can detect the rotation amount of the first roller 31 by detecting its number of rotations. The driving source 21 and the first detection unit 36 are composed of the servomotor. Thus, the configuration of the liquid ejecting apparatus 11 can be simplified in comparison with the case where the driving source 21 and the first detection unit 36 are separately provided.

The embodiment may be implemented with the following modifications. The embodiment and the following modifications may be implemented in combination with each other to the extent that they are not technically inconsistent.

The notification unit 13 may be a bell or a speaker that provides a notification using sound or voice. The notification unit 13 may be a lighting device that provides a notification using lighting and blink of light and the like. The liquid ejecting apparatus 11 may include a plurality of the notification units 13 and may provide a notification using a combination of the notification unit 13.

The notification unit 13 may be provided separately from the liquid ejecting apparatus 11. The control unit 20 may cause a notification unit provided in a terminal owned by the user or worker who performs replacement to make a notification by outputting a signal to the terminal, for example.

The control unit 20 may calculate the diameter D of the wiping member 30 on the basis of the rotation amount of each of the first roller 31 and the conveyance roller 34 at any period from the start of driving of the driving source 21 to the stop of the driving source 21.

The wiping unit 22 may include a moving mechanism that moves the movable gear 46 using a cam and the like, for example.

The liquid ejecting apparatus 11 may include a plurality of the driving sources 21. The liquid ejecting apparatus 11 may include the driving source 21 that drives the first roller 31, and the driving source 21 that drives the second roller 32. The control unit 20 may feed out or back the wiping member 30 by controlling the driving of a plurality of control the driving sources 21.

The liquid ejecting apparatus 11 may include, separately from the wiping unit 22, a liquid waste reception unit that receives the liquid waste ejected as a result of cleaning and flushing.

The liquid ejecting apparatus 11 need not necessarily cure the liquid waste collected by the wiping member 30. The wiping unit 22 may cause the second roller 32 to wind up the wiping member 30 that has absorbed liquid waste, as it is. The wiping unit 22 may be configured such that the wiping member 30 does not return to the first roller 31. In this case, the driving force transmission mechanism 29 need not necessarily include the gear connecting the driving source 21 and the first roller 31.

The conveyance roller 34 may make contact with the wiping member 30 between the pressing portion 39 and the second roller 32.

The wiping unit 22 may include the first roller 31, the second roller 32 and the pressing portion 39, and the second detection unit 37 may detect the rotation amount of the pressing portion 39. That is, the pressing portion 39 may function as a conveyance roller.

The liquid ejecting apparatus 11 may be a liquid ejecting apparatus that injects or discharges liquid other than ink. The state of the liquid ejected from the liquid ejecting apparatus in the form of minute amounts of droplets may include a granular shape, a teardrop shape, and a thread-like tail shape. Here, it suffices that the liquid is a material that can be discharged from the liquid ejecting apparatus. For example, the liquid may be a substance in the liquid phase, and may include a fluid such as a high or low viscosity liquid, sol, gel water, other inorganic solvents, organic solvents, solutions, liquid resins, liquid metals, metal melts, and the like. The liquid may include not only liquid as a phase of a substance, but also particles of functional materials consisting of solids, such as pigments and metal particles, dissolved, dispersed or mixed in a solvent. Typical examples of the liquid include inks and liquid crystals as described in the above embodiments. Here, ink encompasses general water-based and oil-based inks and various liquid compositions such as gel ink and hot-melt ink. Specific examples of the liquid ejecting apparatus include apparatuses that discharges liquids containing materials such as electrode materials and color materials in dispersed or dissolved forms, which are used in the manufacture of liquid crystal displays, electroluminescent displays, surface emitting displays, color filters, and the like. The liquid ejecting apparatus may be apparatuses that discharge bioorganic materials used in biochip production, apparatuses that discharge liquid samples used as precision pipettes, textile dyeing apparatuses, micro-dispensers, and the like. The liquid ejecting apparatus may be an apparatus for discharging lubricant with pinpoint accuracy for precision machines such as watches and cameras, or an apparatus for discharging transparent resin liquid such as UV-cured resin onto a substrate to form micro hemispherical lenses, optical lenses, and the like used for optical communication elements. The liquid ejecting apparatus may be an apparatus that discharges acid or alkali etchant and the like to etch substrates and the like.

Technical ideas and their operations and effects that are derived from the above-described embodiments are described below.

(A) A wiping unit includes a wiping member with a long shape configured to wipe a liquid ejecting head configured to discharge liquid, a first roller around which to wind the wiping member, a second roller configured to wind up the wiping member fed out from the first roller, a driving force transmission mechanism configured to transmit a driving force of a driving source to the second roller, a conveyance roller configured to make contact with the wiping member and rotate along with a movement of the wiping member, a first detection unit configured to detect a rotation amount of the first roller, and a second detection unit configured to detect a rotation amount of the conveyance roller.

The relationship between the feeding amount of the wiping member fed out by the rotation of the first roller and the rotation amount of the first roller changes depending on the diameter of the wiping member wound around the first roller. Since the wiping member has a long shape, it is fed out to the first roller by the amount wound around the second roller and is moved by the amount to rotate the conveyance roller. With this configuration, the first detection unit detects the rotation amount of the first roller, and the second detection unit detects the rotation amount of the conveyance roller. Thus, the remaining amount of the wiping member wound around the first roller can be accurately detected.

(B) The wiping unit may further include a pressing portion configured to press the wiping member toward the liquid ejecting head. The conveyance roller may make contact with the wiping member between the pressing portion and the first roller.

The rotation amount of the conveyance roller with respect to the feeding amount of the wiping member may change depending on the amount of the liquid adhered on the wiping member and the like in some situation. In view of this, in this configuration, the conveyance roller makes contact with the wiping member between the pressing portion and the first roller. That is, the conveyance roller makes contact with the wiping member before the wiping of the liquid ejecting head, and thus the detection accuracy of the remaining amount of the wiping member can be improved.

(C) In the wiping unit, the driving force transmission mechanism may be configured to transmit a driving force of the driving source to the first roller.

With this configuration, the driving force transmission mechanism can transmit the driving force of the driving source to the first roller. That is, the driving source can rotate the first roller and the second roller. When the first roller rotates, the wiping member is fed out from the second roller and fed to the first roller, and, wound around the first roller. When the second roller rotates, the wiping member is fed out to the first roller and fed to the second roller, and, wound around the second roller. Thus, the wiping member fed out from the first roller can be rewound around the first roller.

(D) A liquid ejecting apparatus includes the liquid ejecting head configured to discharge the liquid, the wiping unit with the above-described configuration, the driving source, and a control unit. The control unit calculates a diameter of the wiping member wound around the first roller, based on a detection result of the first detection unit and a detection result of the second detection unit. With this configuration, an effect similar to that of the above-mentioned wiping unit can be achieved.

(E) In the liquid ejecting apparatus, the driving source and the first detection unit may include a servomotor including an encoder.

The driving force transmission mechanism transmits the driving force of the servomotor to the first roller and rotates the first roller. As such, the rotation amount of the first roller is proportional to the number of rotations of the servomotor. That is, the servomotor can detect the rotation amount of the first roller by detecting its number of rotations. With this configuration, the driving source and the first detection unit are composed of the servomotor. Thus, the configuration of the liquid ejecting apparatus can be simplified in comparison with the case where the driving source and the first detection unit are separately provided.

(F) In the liquid ejecting apparatus, the driving source may perform acceleration driving for acceleration when starting driving, constant speed driving for driving at a constant speed, and deceleration driving for deceleration when stopping driving, and the control unit may calculate the diameter based on a rotation amount of each of the first roller and the conveyance roller during the constant speed driving.

With this configuration, the control unit calculates the diameter of the wiping member wound around the first roller on the basis of the rotation amount of each of the first roller and the conveyance roller during the constant speed driving. During the constant speed driving, the slippage between the wiping member and the conveyance roller less occurs than during the acceleration driving and the deceleration driving. Thus, the diameter of the wiping member can be more accurately calculated.

(G) In the liquid ejecting apparatus, the control unit may provide a notification when the diameter that is calculated falls below a predetermined value.

With this configuration, when the diameter of the wiping member wound around the first roller falls below a predetermined value, the control unit provides a notification. Thus, a notification that the remaining amount of the wiping member is small can be provided to the user.

What is claimed is:

1. A wiping unit comprising:

a wiping member with a long shape configured to wipe a liquid ejecting head configured to discharge liquid;

a first roller around which the wiping member is wound;

a second roller configured to wind up the wiping member fed out from the first roller;

a driving force transmission mechanism configured to transmit a driving force of a driving source to the second roller;

a conveyance roller configured to make contact with the wiping member and rotate along with a movement of the wiping member;

a first detection unit configured to detect a rotation amount of the first roller; and a second detection unit configured to detect a rotation amount of the conveyance roller.

2. The wiping unit according to claim 1, further comprising a pressing portion configured to press the wiping member toward the liquid ejecting head, wherein the conveyance roller makes contact with the wiping member between the pressing portion and the first roller.

3. The wiping unit according to claim 1, wherein the driving force transmission mechanism is configured to transmit a driving force of the driving source to the first roller.

4. A liquid ejecting apparatus comprising:

the liquid ejecting head configured to discharge the liquid;

the wiping unit according to claim 3;

the driving source; and a control unit, wherein the control unit calculates a diameter of the wiping member wound around the first roller, based on a detection result of the first detection unit and a detection result of the second detection unit.

5. The liquid ejecting apparatus according to claim 4, wherein the driving source and the first detection unit include a servomotor having an encoder.

6. A liquid ejecting apparatus comprising:

the liquid ejecting head configured to discharge the liquid;

the wiping unit according to claim 1;

the driving source; and a control unit, wherein the control unit calculates a diameter of the wiping member wound around the first roller, based on a detection result of the first detection unit and a detection result of the second detection unit.

7. The liquid ejecting apparatus according to claim 6, wherein the driving source is configured to perform acceleration driving for acceleration when starting driving, constant speed driving for driving at a constant speed, and deceleration driving for deceleration when stopping driving; and the control unit calculates the diameter based on a rotation amount of each of the first roller and the conveyance roller during the constant speed driving.

8. The liquid ejecting apparatus according to claim 6, wherein the control unit provides a notification when the diameter calculated falls below a predetermined value.

* * * * *